US009675505B2

(12) United States Patent
Arzanpour et al.

(10) Patent No.: US 9,675,505 B2
(45) Date of Patent: Jun. 13, 2017

(54) SYSTEM AND METHOD FOR PREVENTING FALL-RELATED INJURIES

(71) Applicant: MOBISAFE SYSTEMS INC., North Vancouver (CA)

(72) Inventors: Siamak Arzanpour, North Vancouver (CA); Maryam Soleimani, Vancouver (CA); Arina Aboonabi, North Vancouver (CA)

(73) Assignee: MOBISAFE SYSTEMS INC., North Vancouver, BC (CA)

( * ) Notice: Subject to any disclaimer, the term of this patent is extended or adjusted under 35 U.S.C. 154(b) by 0 days.

(21) Appl. No.: 14/845,207

(22) Filed: Sep. 3, 2015

(65) Prior Publication Data

US 2016/0067123 A1 Mar. 10, 2016

Related U.S. Application Data

(60) Provisional application No. 62/047,006, filed on Sep. 7, 2014.

(51) Int. Cl.
*A61G 5/10* (2006.01)

(52) U.S. Cl.
CPC ..... *A61G 5/10* (2013.01)

(58) Field of Classification Search
CPC combination set(s) only.
See application file for complete search history.

(56) References Cited

U.S. PATENT DOCUMENTS

2013/0312168 A1* 11/2013 Raanan ..... A41D 13/0506 2/465
2016/0030272 A1* 2/2016 Angold ..... A61H 1/024 623/24

* cited by examiner

*Primary Examiner* — Edward J Pipala

(57) ABSTRACT

A system for preventing fall-related injuries is described. The system comprises a re-useable airbag which can be mounted on a wheelchair, power chair, stroller or scooter or can be design as a hip protector to be put on a waist of a wearer. The system further comprises a fall detection unit that can automatically trigger inflation of the airbag system in case of a fall.

23 Claims, 9 Drawing Sheets

SYSTEM AND METHOD FOR PREVENTING FALL-RELATED INJURIES

FIELD OF INVENTION

This invention relates generally to a system for preventing fall-related injuries and more particularly to a system with a multiple use airbag system employed as a safety system to provide protection to body parts against a fall related injuries.

BACKGROUND OF INVENTION

Unless otherwise indicated herein, the materials described in this section are not prior art to the claims in this application and are not admitted to be prior art by inclusion in this section.

Wheelchair accidents cause injuries with short and long-term consequences (e.g., bed rest, hospitalization, additional disabilities). The medical and recovery expenses of these accidents impose significant economic and social burdens to the patient and the healthcare system (often between $25,000 and $75,000). Over the last 14 years, such accidents registered a compound annual growth rate of 5% where the total number of wheelchair riders has also grown at the same rate. Despite the high accident rate and high cost of incurring these injuries, there are very few technologies to protect the wheelchair riders in case of a fall.

One of these technologies is using anti tippers, which are offered in most power wheelchairs as an "add on" option. Front and rear anti-tippers are attached to increase stability on inclined terrain. But there are no anti tippers to make the chair stable in side falls. Moreover, the main reason for using anti tippers is preventing fall. In case of a fall accident, anti-tippers would not provide any protection to user's critical body parts.

In addition, since 2007, ten million Americans were diagnosed with osteoporosis and 329,000 hip fractures have since been reported. Femoral neck (found in the hip joint) of elderly people can become fragile due to the age. An impact, such as a fall, creates a torque on the femur shaft and femur head that can break the femur neck. One of the highest risks of hip fracture is the post-fracture consequence, such as infections, cardiovascular events, and thromboembolism. These consequences have been linked with a high death rate. Due to an increase in life expectancy, hip fractures are expected to rise from 1.66 million in 1990 to 6.26 million by 2050.

Using traditional airbags on wheelchairs, which are single use airbags, can be expensive and complicated for average wheelchairs/power chairs. Traditional airbags also use chemical reaction which is difficult to control and can be dangerous.

A wearable airbag system disclosed by Fukaya et. al. "Protection against impact with the ground using wearable airbags", Ind Health, 2008, 46(1), 59-65, relies on a one time use container of compressed gas to inflate the airbag(s). While compressed gas containers, are safer and more cost efficient than traditional airbags, there are problems associated with them as well. They are one-time use which means that once the compressed gas is expelled, the container must be replaced or re-filled with gas prior to the next use. The size and deployment time of airbag is also limited to the size and pressure of the gas container.

Furthermore, wearable airbag system configurations include a body-worn gear, which is detachably fitted to the wheelchair user and to which the air bag is attached, to ensure that the air bag may cover the determined parts of the user. So, in order to protect the rider, he/she needs to wear an extra piece of clothing which is heavy and bulky. The inconvenience causes less compliance among riders and as a result, the chance of protecting during fall decreases.

SUMMARY OF THE INVENTION

In one aspect a system for preventing fall-related injuries to a moving object is provided. The system comprises a reusable airbag system to be removably attached to the moving object. The reusable airbag system comprises an airbag cushion configured to inflate and deflate so that upon inflation the airbag cushion protects predetermined parts of the object from fall related injuries. An air movement system is in communication with the airbag cushion to provide air inflow into the airbag cushion to inflate the cushion. The air movement system comprises a motor and an air flowing device. A fall detection unit comprises a plurality of sensors for monitoring movement of the object and a controller for processing signals from the sensors and detecting fall inclination of the object relative to a surface upon which the object is moved. The controller is in communication with the airbag movement system so that it triggers the airbag movement system to deploy the airbag cushion upon fall detection. The reusable airbag system is removably attached to the moving object via a mounting means.

The airbag system comprises at least one valve to control the air flow between the air movement system and the airbag cushion. The at least one valve is an one-way valve to prevent return flow of the air into the air movement system.

In one aspect, the system comprises an enclosure to house at least the airbag cushion and the air movement system. The enclosure further comprises a locking mechanism to keep the enclosure in closed position with the airbag cushion in deflated state secured inside the enclosure.

In another aspect the locking mechanism is an electronic or mechanical lock placed at a door of the enclosure. The locking mechanism has a triggering mechanism in communication with the controller to automatically unlock the locking mechanism.

In one aspect, the airbag cushion comprises a plurality of inner sections. The plurality of inner sections are interconnected by air passages so that the air from one inner section can flow to neighboring inner sections. Each of the inner sections comprises a plurality of inner chambers interconnected to each other.

In another aspect the air movement system further comprises a manifold with plurality of ports, each port being connected to one of the plurality of inner sections.

In one aspect the plurality of sensors include at least one sensor for measuring 3D acceleration and at least one sensor for measuring 3D angular velocity.

In another aspect a method for fall detection and automatically triggering an airbag system for preventing fall-related injuries to a subject is provided. The method comprises measuring 3D acceleration and 3D angular velocity of the subject using a plurality of sensors, processing the signals obtained from the plurality of sensors and detecting fall inclination of the subject relative to a surface upon which the subject is moved and triggering an air movement system to automatically deploy an airbag cushion upon fall inclination is detected.

In one aspect the system is used on a wheel chair to protect a rider of the chair in case of a chair fall.

In yet another aspect, the system is used as a hip protector to be mounted over clothes of a wearer.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

DETAILED DESCRIPTION OF SPECIFIC EMBODIMENTS

Figure 1:
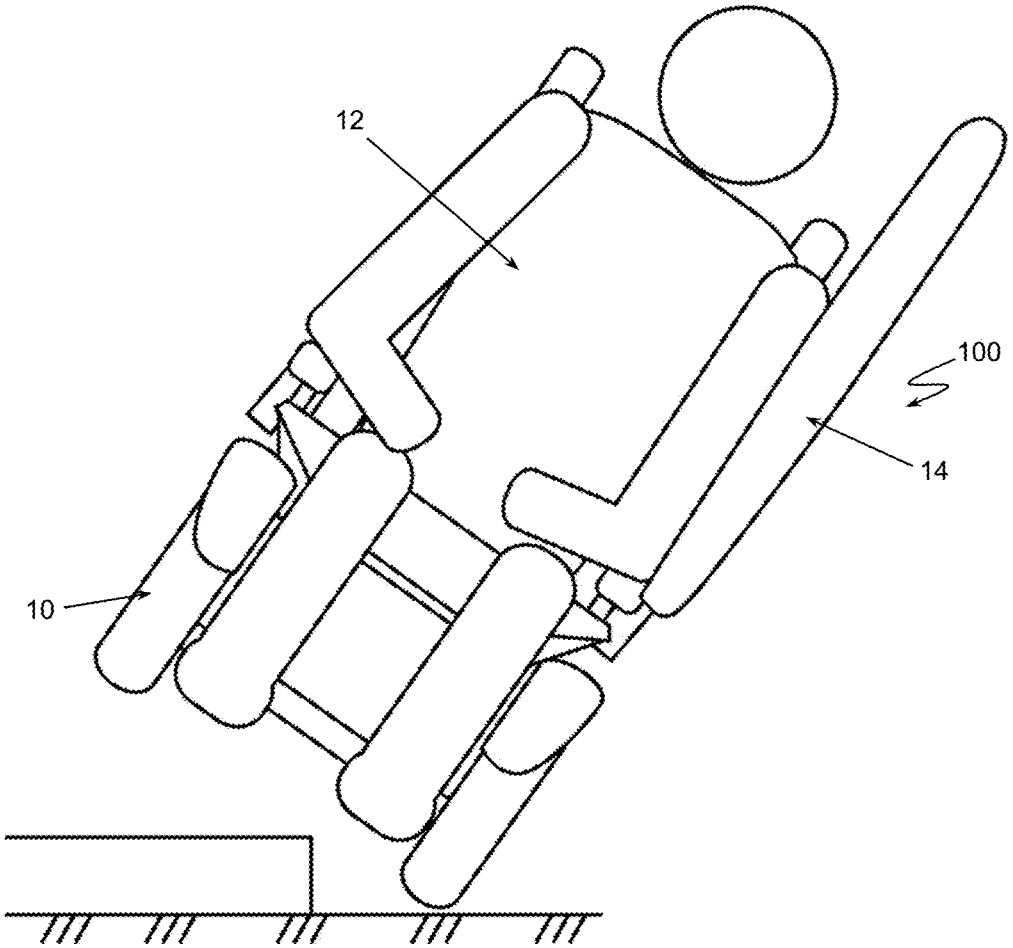
FIG. 1 is a front view of a power chair with an example of a system for preventing fall-related injuries showing a deployed airbag cushion in a fall scenario.

In one mode of operation, the airbag system of the present invention is a multiple-use airbag system that can be used on wheelchairs, power chairs and scooters or can be wear by a user, e.g. as a hip protector. The airbag can be automatically opened when there is a chance of a fall. An example scenario is illustrated in FIG. 1 showing a wheel chair 10 with a rider 12 in sited position. When the chair 10 is tilted at an edge of a curb a side airbag cushion 14 of an injury protecting airbag system 100 can be deployed.

Figure 2:
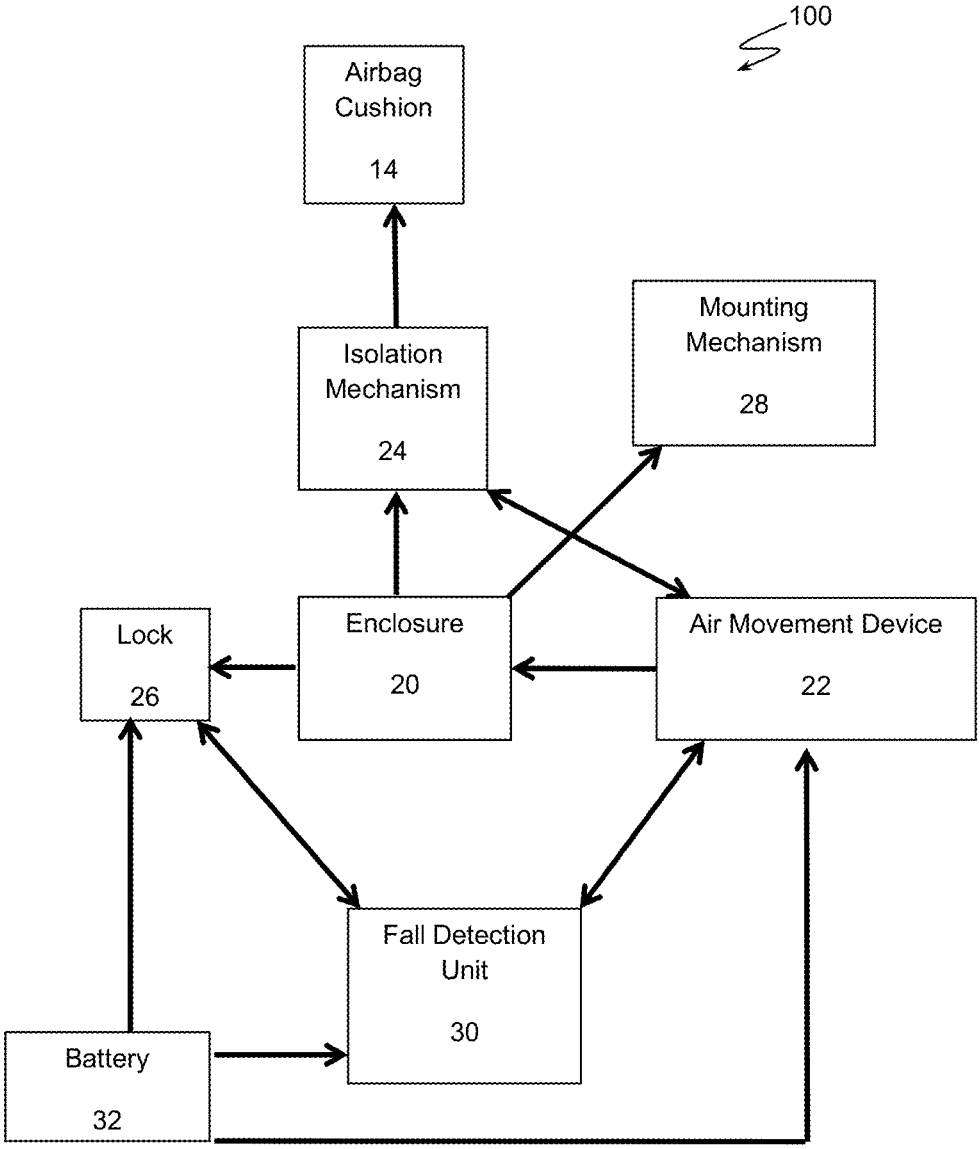
FIG. 2 is a flow chart of an example of a system for preventing fail-related injuries showing its components and subsystems.

Main components and sub-systems of the airbag system 100 are illustrated in the flowchart in FIG. 2 showing the interaction/communication of each sub-system/component. The system 100 includes an enclosure 20 which is configured to house the airbag cushion 14 and an air movement system 22. The communication between the air bag cushion 14 and the air movement system 22 is provided through at least one valve/isolator 24. In some implementations of the system 100 a lock 26 can be provided to lock the enclosure 20 and make sure the airbag cushion 14 is securely locked within the enclosure 20. The enclosure 20 can be attached to a wheelchair via mounting mechanism 28. A fall detection unit (FDU) 30 can also be provided. The FDU 30 can be located within the enclosure 20 or remotely from the enclosure 20. The FDU 30 can comprise all sensors, a controller (e.g. a microcontroller) and electronic interfaces, and can be configured to control the opening of the airbag system 100. For example, a wheelchair movement can be monitored by a plurality of sensors. The controller receives the signals of the wheelchair movement from the plurality of sensors and processes and analyzes such signals to detect any inclination from the surface the chair is moving to indicate a potential falling event. Upon detection of a potential fall, the FDU 30 can send a signal to the air movement system 22 to turn it on and deploy the airbag cushion 14. If there is an active locking mechanism in place, such as for example the lock 26, the FDU 30 can simultaneously send a signal to the lock 26 to open the enclosure 20 while the airbag cushion 14 is deploying. In one implementation the airbag system 100 can be powered by a battery 32. In another implementation the system 100 can connect to the power chair battery.

Figure 3:
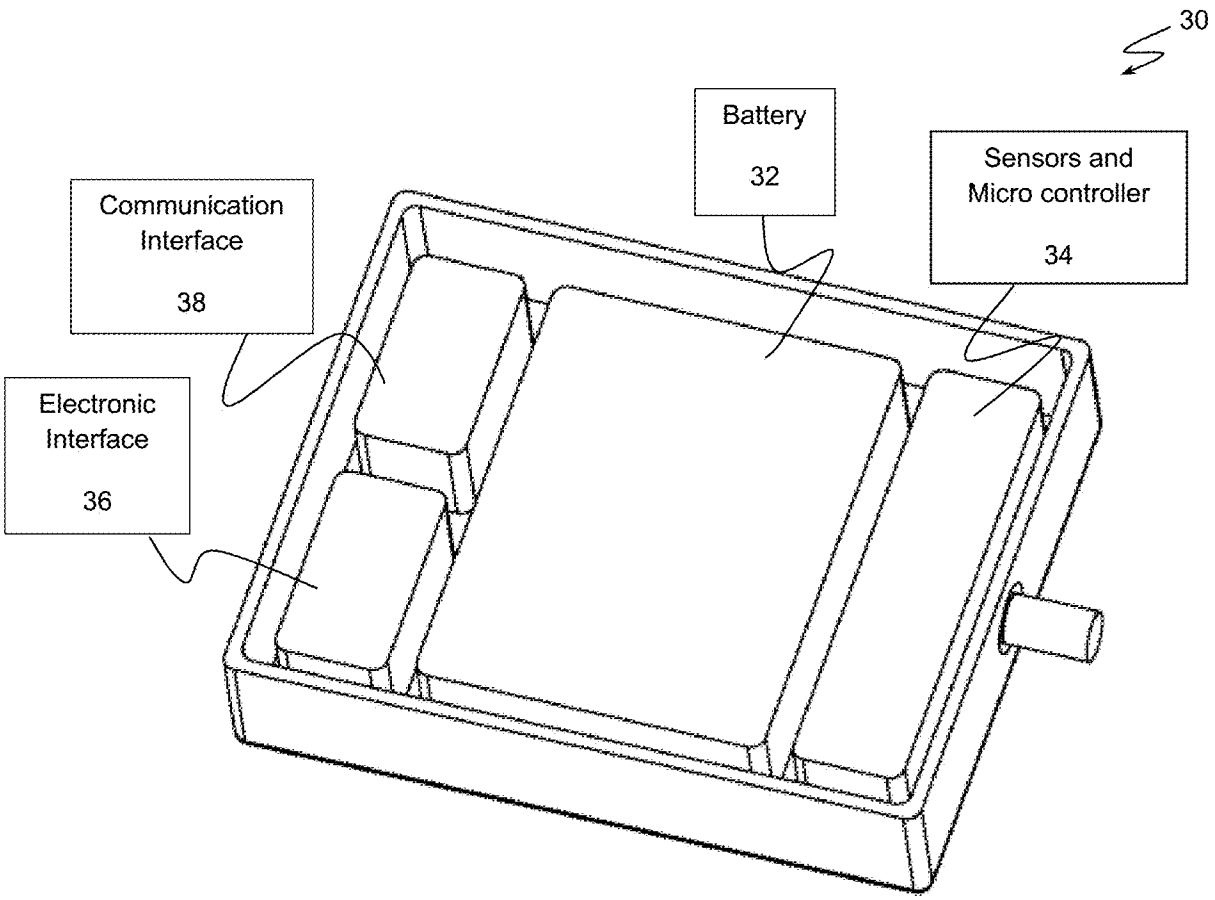
FIG. 3 is a perspective cross-sectional view of an example of a fall detection unit.

FIG. 3 shows details of the fall detection unit (FDU) 30 comprising a sensory board and a controller 34 and related electronic interfaces 36 and communication interface 38. The FDU 30 can be positioned within the airbag enclosure 20 or can be a separate independent component in communication with the enclosure 20 with a proper wiring or wireless (e.g. through a bluetooth). The FDU 30 can be self-powered with the battery 32 or it can be connected to the power chair battery.

The sensory board of the FDU 30 can include at least one sensor for measuring 3D acceleration and also at least one sensor for measuring 3D angular velocity. These sensors will constantly capture motion data from the chair (or any other moving object to which the system 100 is mounted) and transfer the signals to the controller. The controller will process the data obtained from the sensors to determine whether the power chair is in a fall position or not. If a fall is detected the controller will send a signal to trigger the air movement system 22. In case a lock 26 is used to close the enclosure 20, the FDU 30 will also send a signal to the lock 26 to open/unlock the airbag enclosure 20.

Figure 4:
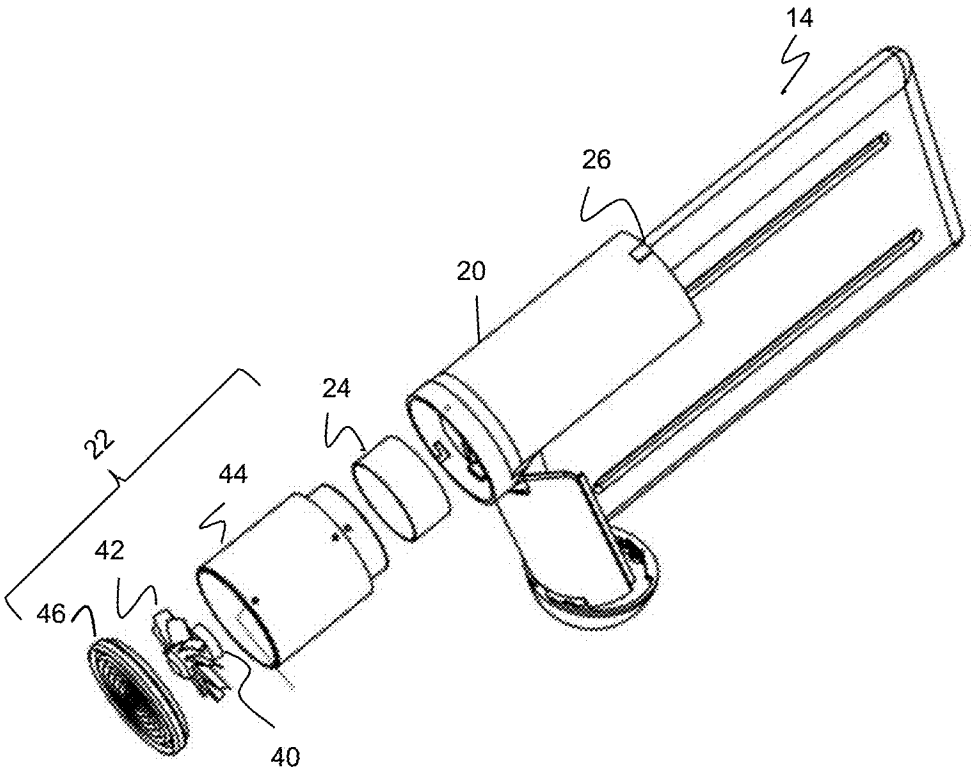
FIG. 4 is an exploded view of an example of a cylindrical hard-shell airbag enclosure and its internal parts.

FIG. 4 illustrates one example of the airbag enclosure 20 and the components housed therein. The enclosure 20 can house an inflatable airbag 14, an air movement system 22, a locking mechanism 26 and a valve 24.

Figure 5A:
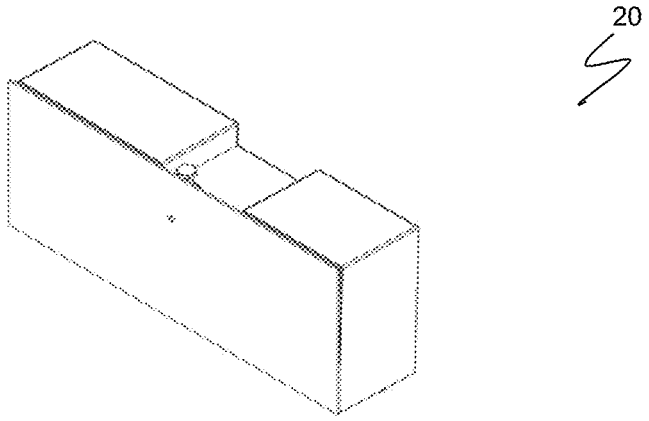
FIG. 5*a* is a perspective view of an example of an airbag enclosure designed for mounting under a wheelchair's arm rest.
Figure 5B:
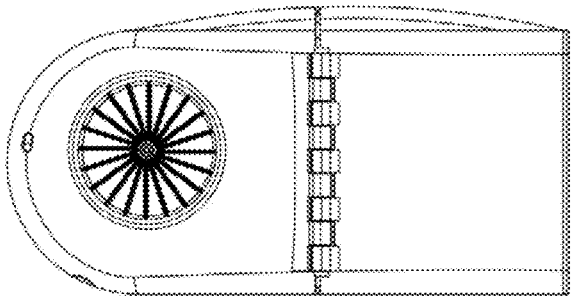
FIG. 5*b* is a top view of an example of an airbag enclosure designed for protecting user's head.
Figure 5C:
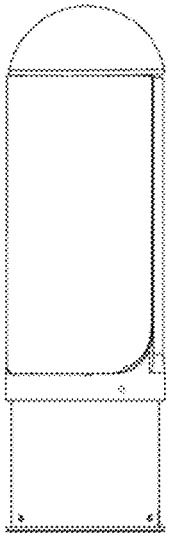
FIG. 5*c* is a side view of an example of a cylindrical airbag enclosure designed for protecting a head and an upper body of a user.

The airbag enclosure 20 can be a hard shell or a hybrid of a hard shell and flexible pouch. The hard shell design can be made of a lightweight and rigid material and can be sized and shaped to enclose the airbag cushion 14 and the air movement system. FIG. 5 shows three different example designs for the hard shell enclosure sized and shaped to be mounted at different locations on the chair. Person skilled in the art would understand that the enclosure 20 can have various other designs, sizes or shapes without departing from the scope of the invention. The hybrid design of the enclosure 20 can comprise a waterproof flexible fabric bag (pouch) to enclose the airbag cushion 14 and for example the lock 26, while the air movement system 22 can be placed inside the rigid shell (e.g. housing 44 of FIG. 4). The rigid shell is adjacent to the waterproof flexible pouch and is in fluid communication with the airbag cushion placed inside the pouch.

The air movement system 22 can comprise a motor 40 such as for example a DC brushless motor which is connected to a power source and which operate an air flowing device 42. The air flowing device 42 can be a propeller fan, an impeller, an air blower, or a compressor. The air movement system 22 can be securely placed within a housing 44 and attached to the airbag cushion 14 via at least one valve/isolator 24. A safety cap 46 can be placed on a top of the air movement system 22 to prevent any interference with the adjacent objects.

The valve 24 can comprise an adapter (not shown) to connect the air flowing device 42 (e.g. the fan 42) to the airbag cushion 14. The valve 24 can be a one-way valve to prevent the air to escape from the airbag cushion 14.

The locking mechanism 26 can be placed in the airbag enclosure 20 for example at an opening door (lid) of the enclosure 20. In one implementation, the locking mechanism 26 can be a passive mechanism like permanent magnets placed on the two side of the opening door of the enclosure 20. Due to attraction between the poles of the magnets the enclosure's door can remain closed when in regular motion. But when airbag cushion is deployed, it will overcome the magnetic force and rip the door open. In another implementation, the lock 26 can be a miniature electric or mechanical lock with locking mechanism that is controlled by the FDU 30. In case of a fall, the controller sends signals (simultaneously) to both the air movement system 22 and the lock 26 so that the enclosure 20 is opened at the same time that the airbag cushion 14 is deployed.

Figure 6:
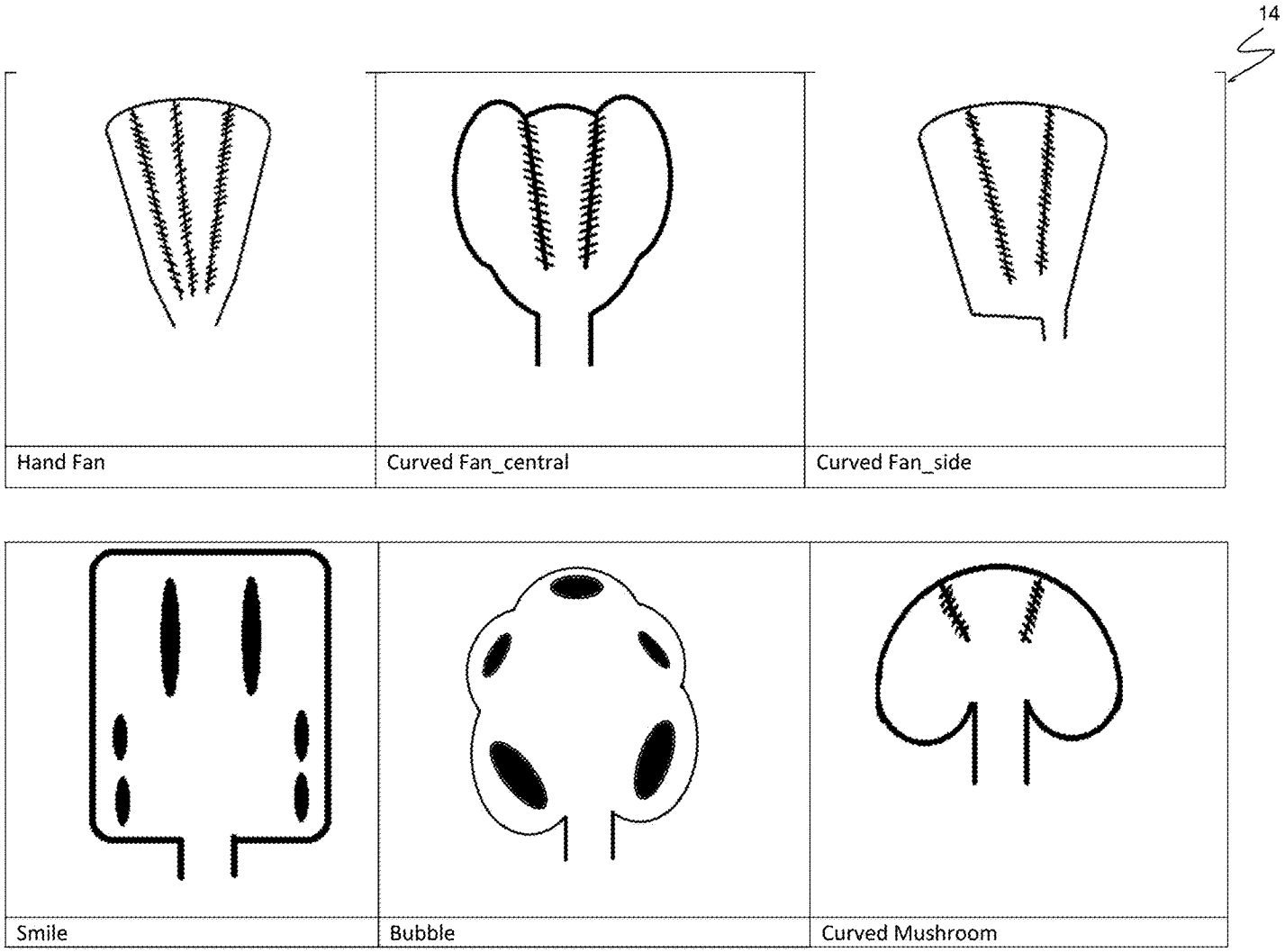
FIG. 6 shows various examples of airbag cushion's designs.

The inflatable airbag 14 can be made of a tear-resistant material such as nylon with poly urethane coating. Other materials can be used as well without departing from the scope of the invention. The airbag cushion 14 contains inner cavity that is sized and shaped so that during inflation it is quickly filled with gas, but during the impact the gas outflow is delayed. In one implementation, the inner cavity of the airbag cushion can be sectioned providing a plurality of inner sections/chambers. For example each of the inner sections can be connected to the neighboring sections with one or more air passages. In one embodiment, each of the inner sections can comprise multiple inner chambers so that the smaller chambers can inflate faster and can provide enough protection to body parts during impact. By sectioning the airbag, smaller areas will be fully inflated faster to quickly provide enough protection for the user. Another reason for sectional airbag design is that it will delay the air outflow when the user falls on top of it. In one implementation, all of the inner sections/chambers can be separated and each of such chambers can inflate separately and independently from each other. For example, each of the inner section can be connected to the air movement system 22 via a separate valve 24. The air movement system 22 can comprise a manifold with a number of ports, each of the ports connected to a separate inner section of the cushion 14. In such embodiment, each of the inner section can be deployed automatically at the same time. In one embodiment, the system can comprise one or more vent-valves to provide slow release of the airbag cushion upon a fall impact. FIG. 6 illustrates a number of different configurations of sectional airbag designs. These are for illustrational purposes only and the airbag cushion can have any other suitable shape and design without departing from the scope of the invention.

The motor 40 and the fan 42 of the air movement system 22 can be pre-programmed to automatically stop within a pre-determined time sequence from the start. For example, it can be set up to turn off after few (tens) seconds from the time the air starts flowing into the airbag cushion 14. In one implementation, the system 100 can comprise a pressure sensor (not shown) positioned inside the airbag cushion 14 or in communication with the airbag cushion for measuring the pressure within the airbag cushion, so when the pressure reaches a certain, pre-determined threshold, the sensor sends a signal to the FDU 30 to turn the air movement system 22 off.

In the illustrated example shown in FIG. 4, the enclosure 20 houses all the airbag components except the FDU 30. In yet another implementation, the enclosure 20 can further comprise a shootout mechanism (not shown). The shootout mechanism can include a loaded pushing mechanism, such as a spring to push the airbag cushion 14 outward from the enclosure 20 when the enclosure 20 is opened and airbag cushion 14 is deployed, so that the deployment time is further decreased.

The outer enclosure can come in different shapes, such as rectangular (FIG. 5*a*), cylindrical (FIGS. 5*b* and 5*c*) or any other shape which integrates well with the design of wheelchair. In another embodiment, the enclosure 20 can include all the airbag components including the FDU.

Figure 7:
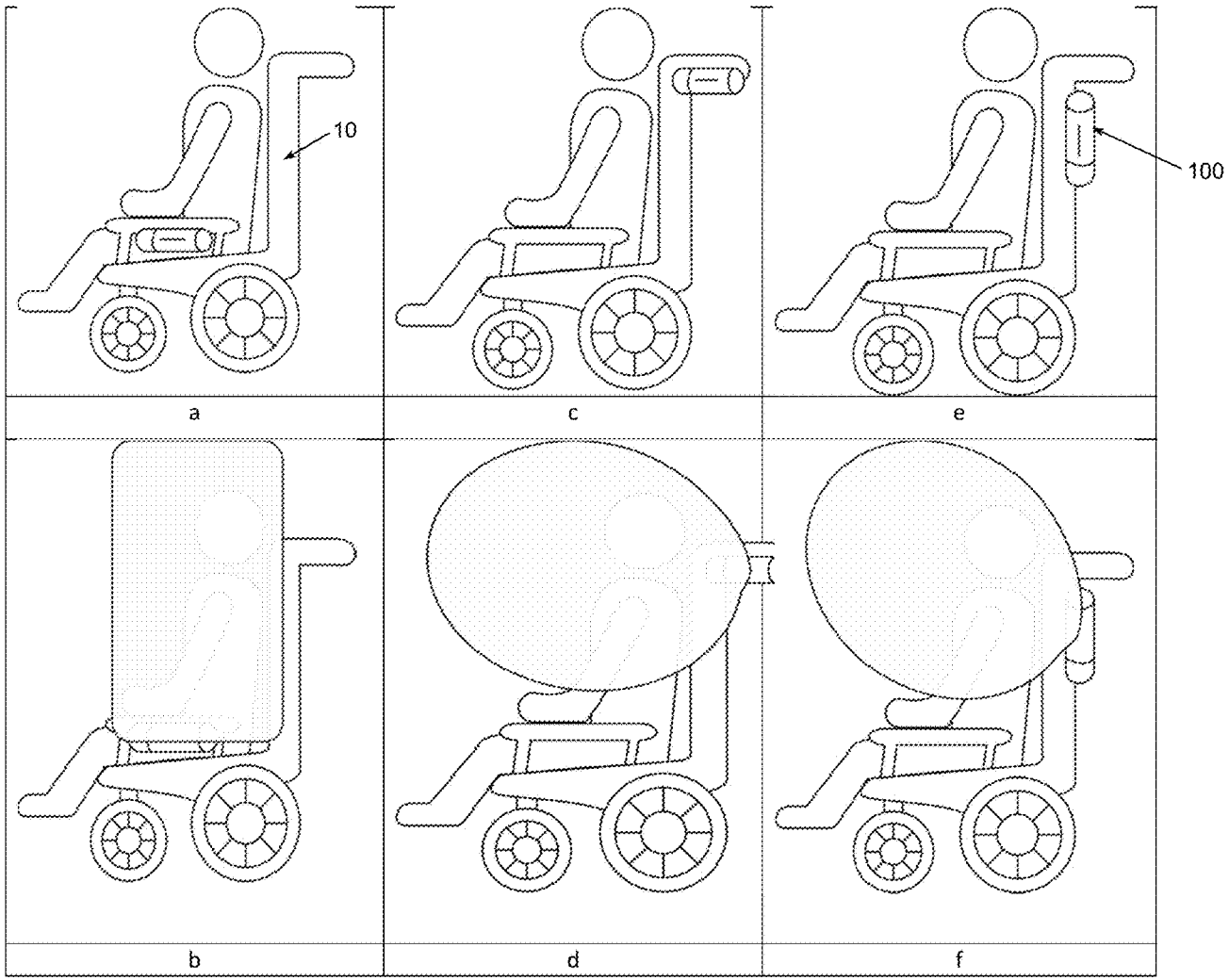
FIG. 7 shows various examples of airbag enclosure placed at different places of a wheelchair in both closed form (7*a*, 7*c* and 7*e*) and deployed form (7*b*, 7*d* and 7*f*).

The airbag system 100 can be attached to power chair 10 in different places, as shown in FIG. 7, based on user's preference. The mounting attachment 28 can be fixed or moveable based on the place of installation. For example, the mounting attachment 28 can include straps or Velcro tapes or any other fastener that can allow the system 100 to be easily attached to and detached from the chair 10. In one embodiment the airbag system 100 can be placed under the armrest (see FIG. 7*a*) such that upon inflation it covers the upper body of user as illustrated in FIG. 7*b*. In another embodiment, the system 100 can be attached to the handle of chair 10 (see FIG. 7*c*) such that it deploys close to user's head (see FIG. 7*d*). In yet another embodiment, the system 100 can be attached to the body frame of the chair as illustrated in FIG. 7*e*, so it can protect both head and upper body as shown in FIG. 7*f*. The placement of mounting mechanism in any of the embodiments illustrated in FIG. 7 is such that the installed airbag system 100 would not exceed power chair's foot print nor it will block user's body during the transfer in and out of the chair 10.

Person skilled in the art would understand that the system of the present invention can be applicable for preventing fall-related injuries in any other mobile applications such as scooters, walkers, and strollers.

Figure 8:
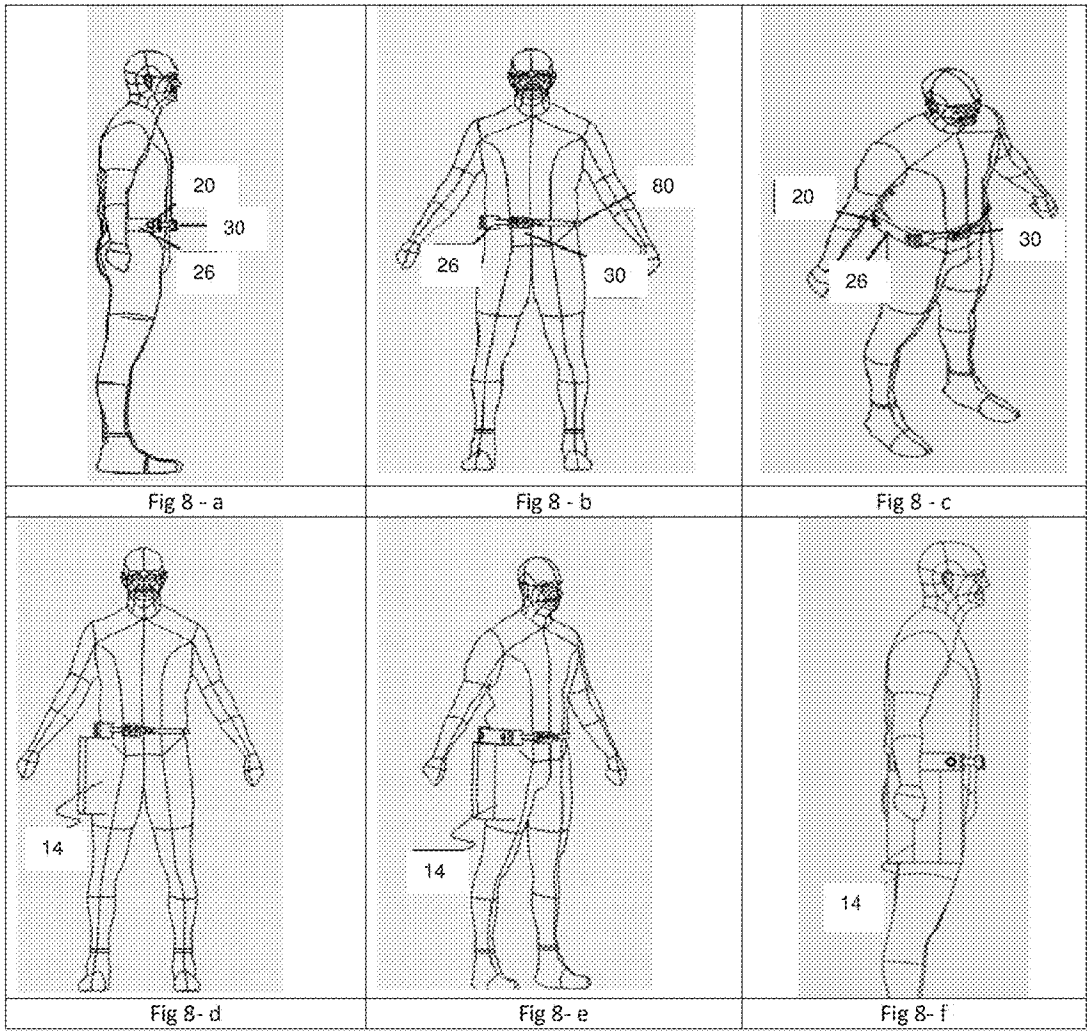
FIG. 8 shows various examples of a system for preventing fall-related injuries designed as a hip protector mounted on a human body with an airbag in closed form (8*a*, 8*b* and 8*c*) and deployed form (8*d*, 8*e* and 8*f*).

In another mode of operation, the system of the present invention can be design as a re-useable hip protector system used to prevent hip fractures by protecting the neck of the femur. For example, FIG. 8 illustrates such hip protector system secured around the waist of a user. The hip protector system can be the same as the system 100 but shaped and sized to be worn outside of the users clothing and secured around the waist of the user using a belt and belt fastener. It can contain airbag cushion located on the side of the user's waist so that once inflated, it will protect the side of hip and thigh. When the FDU of the system detects that the user is falling, a high-powered air moving system will begin inflation to the airbag cushion. The airbag cushion will be released out of the fabric that is locked together using magnets or any other electronic or mechanical miniature lock. At least one valve (e.g. one-way valve) is placed between the airbag cushion and air movement device (as described herein with respect to FIG. 4) to ensure that the air does not rush back to the source once the user has fallen on top of the airbag cushion. The one-way valve can be designed to slowly let out air once the fall has been avoided. In one implementation, one or more air vents can be used to slowly and controllably release the air out of the cushion upon fall or to deflate the airbag cushion for folding it into the enclosure.

The invention is superior to other designs due to the ability of reusability. The airbag cushion 14 after the falling incident can be deflated, folded back and locked back into the enclosure 20 so that the user can remain protected in case of another incident. The known airbag systems use an air cartridge that could be used all at once if there is no air management system built into that product. In addition, such air cartridges need to be replaced or refilled after each deployment.

FIG. 8*a* shows how the main components of the system 100 sit on the side of the body. The enclosure 20 contains the non-inflated airbag inside with proper passages to ensure that the airflow to the airbag cushion is not blocked. The locking mechanism 26 keeps the enclosure 20 closed. The FDU 30 containing microcontroller and sensors is placed in the front of the user. The FDU 30 will determine whether the user is falling which will trigger the air movement system to inflate the airbag cushion. This image only shows the system 100 on one side of the human body, but such system will be placed on both sides of the human body to protect both hips.

FIG. 8*b* shows a front view of the invention mounted on the human body. The FDU 30 will sit securely on a canvas belt 80. The belt can contain a belt fastener that will be able to adjust to fit most sizes.

FIG. 8*c* shows how the system will be secured on the belt. FIGS. 8*d* to 8*f* show the system with the airbag cushion 14 deployed and fully inflated. The length of the airbag cushion 14 when inflated will cover greater trochanter bone and adjacent area and will ensure that all aspects of the hip bone and the sides of the hip are protected on impact. The airbag cushion 14 will be sewn and sealed airtight to ensure that it will not leak any air and rip open when the user falls on it. In one embodiment, the airbag has been designed so that there will be multiple sections that will be filled by air. By sectioning the airbag, smaller areas will be created to fully inflate and provide enough protection for the user. Another reason for sectional airbag design is that it will be difficult for the air to return to air moving device when the user falls on top of it.

Figure 9:
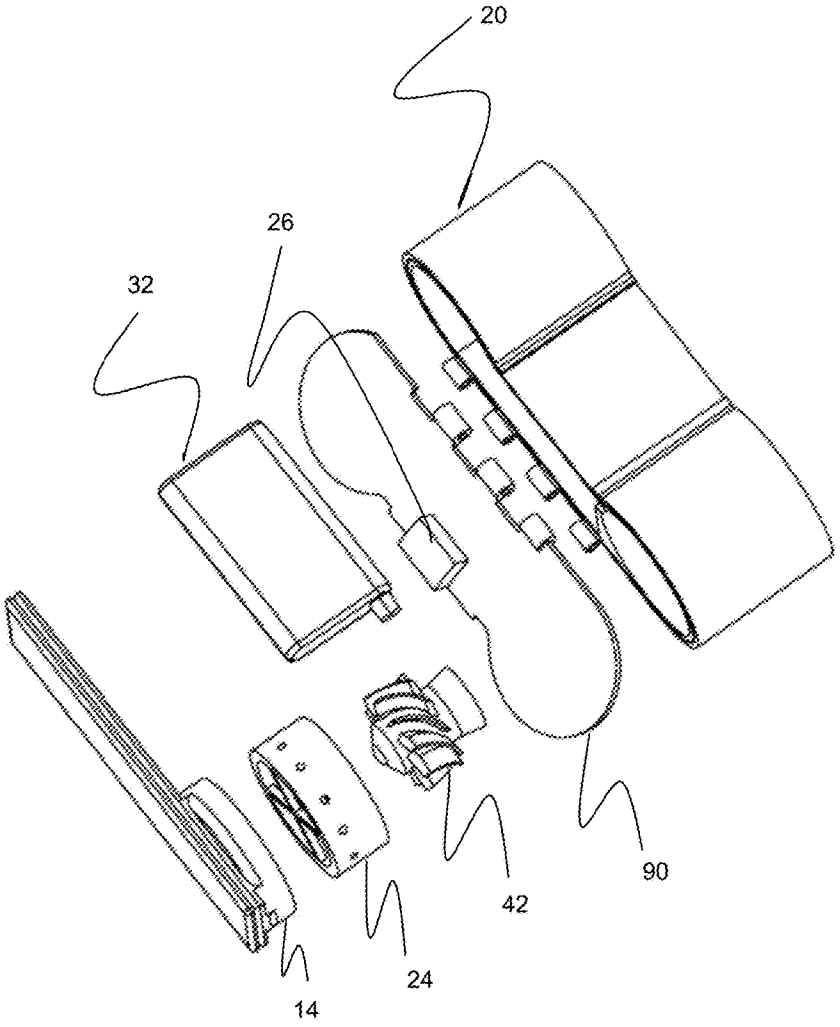
FIG. 9 is an exploded view of an example of an enclosure design as hip protector and its internal parts.

FIG. 9 shows another example of the enclosure 20 shaped and sized to be worn by a user as a hip protector. It includes an air flowing device 42 which guides and pressurizes ambient air into the airbag cushion 14. The airbag cushion 14 and air flowing device 42 are connected through a valve/isolator 24 (e.g. one-way valve). A piece of fabric (acting as gate of a one way valve) can sit on the tip of the air valve to block the air from returning back to the source. When the person falls on the airbag, the air will try to skip through any opening, including the air movement device. The fabric can act as a damper to dampen the airflow from returning to the air moving device.

The locking mechanism 26 for the unit is placed on the door 90 of enclosure 20. The battery 32 can be placed inside enclosure as well. In another embodiment battery 32 can be placed within the FDU. The FDU can be independent from the enclosure 20 and connected to the belt next to the enclosure 20.

The system of the present invention can be used in similar applications to protect other critical body parts without departing from the scope of the invention.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and sub-combinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

The invention claimed is:

1. A reusable airbag system removably attached to a movable object, the system comprising:

an airbag cushion configured to inflate and deflate, upon inflation the airbag cushion protecting predetermined parts of a user from fall related injuries;

an air movement system in communication with the airbag cushion, the air movement system comprising a motor connected to a power source and an air flowing device configured to provide air inflow into the airbag cushion to inflate the cushion;

a controller in communication with the air movement system and being configured to turn on the air movement system and to turn off the air movement system to control an air pressure in the airbag cushion;

a fall detection unit having a plurality of sensors to capture a position, a direction and a velocity of the object relative to a surface upon which the object is moved and produce signals of the position, direction and the motion of the object, the controller receiving the signals obtained from the sensors and detecting a fall inclination of the object and triggering the air movement system upon fall inclination detection; and means for removably attaching the reusable airbag system to the moving object, wherein the airbag system being reusable without replacing the air movement system.

2. The system of claim 1, further comprising an enclosure to house at least the airbag cushion and the air movement system.

3. The system of claim 1, further comprising at least one valve to control the air flow between the air movement system and the airbag cushion.

4. The system of claim 3, wherein the at least one valve is an one-way valve to prevent return flow of the air into the air movement system.

5. The system of claim 4, further comprising one or more air vents connected to the airbag cushion to allow slow release of the air out of the airbag cushion upon fall impact.

6. The system of claim 1, wherein the air flowing device is selected from a group of a propeller, impeller, an air blower, and compressor.

7. The system of claim 1, wherein the airbag cushion comprises a plurality of inner sections.

8. The system of claim 7, wherein the plurality of inner sections being interconnected by air passages so that the air from one inner section can flow to neighboring inner sections.

9. The system of claim 7, wherein each of the inner sections comprising a plurality of inner chambers interconnected to each other.

10. The system of claim 7, wherein the air movement system further comprises a manifold with plurality of ports, each port being connected to one of the plurality of inner sections.

11. The system of claim 2, further comprising a locking mechanism to keep the enclosure in closed position with the airbag cushion in deflated state secured inside the enclosure.

12. The system of claim 11, wherein the locking mechanism is an electronic or mechanical lock placed at a door of the enclosure, the locking mechanism having a triggering mechanism in communication with the controller to automatically unlock the locking mechanism.

13. The system of claim 1, wherein the plurality of sensors include at least one sensor for measuring 3D acceleration and at least one sensor for measuring 3D angular velocity.

14. The system of claim 2, wherein the fall detection unit is located within the enclosure.

15. The system of claim 1, wherein the fall detection unit is remote from the air movement system and is wirelessly connected to the air movement system.

16. The system of claim 1, wherein the controller is pre-programmed to stop the air movement system within a pre-determined time sequence from the deployment of the airbag cushion.

17. The system of claim 1, further comprising a pressure sensor for measuring the pressure within the airbag cushion, the controller receiving a signal from the pressure sensor, the controller being programmed to turn off the air movement device once the pressure in the airbag cushion reaches a threshold value.

18. The system of claim 12, wherein the fall detection unit is wirelessly connected to the locking mechanism.

19. The system of claim 2, further comprising a preloaded pushing mechanism to push the airbag cushion out of the enclosure when the enclosure is opened.

20. The system of claim 1, wherein s self-powered by a battery.

21. The system of claim 1, wherein the system is being used as power chair airbag protection system for protecting a rider from a fall-related injuries.

22. The system of claim 1 wherein the system is being used as a wearable airbag system to be used by a user as a hip protector.

23. A method for fall detection and automatically triggering an airbag system for preventing fall-related injuries to a subject, the method comprising:

measuring 3D acceleration and 3D angular velocity of the subject using a plurality of sensors, the plurality of sensors providing input signals to a controller, the controller being in communication with the plurality of sensors and comprising an input unit to receive the input signals from the plurality of sensors, a processing unit and an output unit;

processing the signals obtained from the plurality of sensors by the processing unit of the controller, the processing unit detecting a fall inclination of the subject relative to a surface upon which the subject is moved and providing an output signal to the output unit to trigger the airbag system; and controlling an air pressure in the airbag system by the controller by turning on and turning off an air movement system, wherein an airbag cushion is deployed upon the fall inclination is detected and the airbag cushion is deflated and folded back upon a falling incident is over, the airbag system being reusable without replacing the air movement system.

* * * * *